US007144600B2

(12) United States Patent
DeMott

(10) Patent No.: US 7,144,600 B2
(45) Date of Patent: Dec. 5, 2006

(54) WAX-FREE LUBRICANT FOR USE IN SIZING YARNS, METHODS USING SAME AND FABRICS PRODUCED THEREFROM

(75) Inventor: Roy P. DeMott, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 144 days.

(21) Appl. No.: 10/368,145

(22) Filed: Feb. 18, 2003

(65) Prior Publication Data

US 2004/0161604 A1 Aug. 19, 2004

(51) Int. Cl.
*B05D 3/02* (2006.01)

(52) U.S. Cl. ..... 427/389.9; 427/392; 427/393.1; 427/394; 427/396

(58) Field of Classification Search ..... 427/385.5
See application file for complete search history.

(56) References Cited

U.S. PATENT DOCUMENTS

| | | | | |
|---|---|---|---|---|
| 3,338,830 | A | 8/1967 | Stokes et al. | |
| 3,416,952 | A | 12/1968 | McIntyre et al. | |
| 3,546,008 | A | 12/1970 | Shields et al. | |
| 3,625,754 | A * | 12/1971 | Dunn | 428/395 |
| 3,682,583 | A * | 8/1972 | Kravetz et al. | 8/138 |
| 3,779,993 | A | 12/1973 | Kibler et al. | |
| 3,899,614 | A | 8/1975 | Okamoto et al. | 427/175 |
| 3,959,230 | A * | 5/1976 | Hays | 528/297 |
| 4,015,317 | A | 4/1977 | Johnsen | |
| 4,035,531 | A | 7/1977 | Lark | |
| 4,111,816 | A | 9/1978 | Login | |
| 4,145,461 | A | 3/1979 | Lerman et al. | |
| 4,158,083 | A | 6/1979 | Login | |
| 4,215,026 | A | 7/1980 | Login | |
| 4,216,260 | A | 8/1980 | Buckley | |
| 4,314,000 | A | 2/1982 | Thir et al. | |
| 4,370,143 | A * | 1/1983 | Bauer | 8/493 |
| 4,640,946 | A | 2/1987 | Vassallo et al. | 524/45 |
| 4,756,714 | A | 7/1988 | Hendrix et al. | |
| 4,844,709 | A | 7/1989 | Marten | |
| 4,845,140 | A | 7/1989 | Marten | |
| 4,977,191 | A | 12/1990 | Salsman | |
| 4,981,905 | A | 1/1991 | Simons et al. | |
| 5,156,651 | A | 10/1992 | Girardeau et al. | |
| 5,290,631 | A | 3/1994 | Fleury et al. | |
| 5,362,515 | A | 11/1994 | Hayes et al. | 427/155 |
| 5,421,378 | A | 6/1995 | Bowers et al. | |
| 5,503,197 | A | 4/1996 | Bower et al. | |
| 5,525,702 | A | 6/1996 | Nace | |
| 5,569,408 | A | 10/1996 | Peppmoller et al. | |
| 5,571,620 | A | 11/1996 | George et al. | |
| 5,626,952 | A | 5/1997 | McAbee et al. | |
| 5,645,892 | A * | 7/1997 | Whitley et al. | 427/393.4 |
| 5,646,237 | A | 7/1997 | George et al. | |
| 5,648,010 | A | 7/1997 | Dewitt et al. | |
| 5,709,940 | A | 1/1998 | George et al. | |
| 5,725,951 | A | 3/1998 | Schuette et al. | |
| 5,935,484 | A | 8/1999 | Schuette et al. | |
| 5,942,176 | A | 8/1999 | Fujii et al. | |
| 6,093,491 | A * | 7/2000 | Dugan et al. | 428/397 |
| 6,162,890 | A | 12/2000 | George et al. | |
| 6,204,353 | B1 | 3/2001 | Eicken et al. | |
| 6,537,662 | B1 | 3/2003 | Kamrath et al. | |
| 2001/0008823 | A1 | 7/2001 | Ghorashi | |
| 2001/0044249 | A1 | 11/2001 | Demott et al. | |
| 2001/0051706 | A1 | 12/2001 | George et al. | |
| 2002/0007516 | A1 | 1/2002 | Wang | |
| 2002/0056178 | A1 | 5/2002 | Tam et al. | |
| 2002/0189703 | A1 | 12/2002 | Medeiros et al. | |
| 2004/0029473 | A1 * | 2/2004 | McKee et al. | 442/181 |

FOREIGN PATENT DOCUMENTS

| | | | |
|---|---|---|---|
| EP | 0877837 B1 | | 10/1999 |
| JP | 6158538 | | 6/1994 |
| WO | WO 92/17336 | * | 10/1992 |
| WO | WO 01/11136 A1 | | 2/2001 |
| WO | WO 02/30582 A1 | | 4/2002 |

OTHER PUBLICATIONS

Suchecki et al, Textile Industries (Atlanta), 131(7), pp. 122-123 and seq., 1967.*
Kravetz, Textile Chemist and Colorist, 5(1), pp. 29-34, 1973.*
Livengood et al, Textile Chemist and Colorist, 12(4), pp. 67-70, 1980.*
Ferguson, American Dyestuff Reporter, 71(6), pp. 43-47, 1982.*
Advertisement from Calgati Chemical Company Ltd., dated May 9, 2001.
Extract from "Textile Magazine," Journal, Elsevier Science Ltd, Copyright 2002.

* cited by examiner

*Primary Examiner*—Erma Cameron
(74) *Attorney, Agent, or Firm*—Terry T. Moyer; Cheryl J. Brickey

(57) ABSTRACT

A finishing composition containing a nonionic hydrophilic macromolecule can replace wax in sizing while providing lubrication to yarns during weaving. Softer yarns and fabrics are obtained than with conventional sized yarns while also providing improved adhesion and dyeability.

9 Claims, No Drawings

WAX-FREE LUBRICANT FOR USE IN SIZING YARNS, METHODS USING SAME AND FABRICS PRODUCED THEREFROM

FIELD OF INVENTION

This invention relates to a method for protecting textile yarns, such as spun yarns, during processing prior to and during use to manufacture textile fabrics, to the textile yarns so produced and to the fabrics made from such textile yarns.

BACKGROUND OF THE INVENTION

Most cotton and synthetic fiber staple yarns are sized prior to weaving, knitting or other manufacturing technique. Various types of natural and/or synthetic polymers are used for sizing to protect the fibers and yarns from the usual abrasion against the manufacturing equipment or other fibers/yarns. Such abrasion, in the absence of protective sizing, tends to cause various types of damage, such as breakage, pulling, pilling, and the like. Such damage is especially problematic when the fibers/yarns are subject to high speed processing, since otherwise the processing units need to be stopped to remove and/or repair damaged fibers and yarns.

Even if the fibers or yarns are not broken, other types of damage occurring during fabric formation could result in non-uniformities in the fabric. Such nonuniformities can lead, in turn, to uneven dyeing and finishing operations, thereby reducing the value of the resulting fabric.

Sizes for yarns made from natural fibers such as cotton generally are largely based on natural polymers and their derivatives, e.g., starches, various types of modified starches, and cellulose derivatives. With the advent of synthetic fibers and synthetic fiber containing fabrics (e.g., polyesters, polyacrylates, polyamides, polyarylamides and the like), synthetic polymers have been employed as the sizing agents for yarns. Examples of such synthetic polymers include, polyvinyl alcohols, partially esterified poly (vinylacetate), polyesters and others. Representative sizing agents for yarns are shown in the following Table 1.

TABLE 1

Polymeric Sizing Agents Used In Textile Processing

| Natural Polymer | Synthetic Polymers |
|---|---|
| Starches | Poly(vinyl alcohol) |
| Modified or Refined Starches | Poly(vinyl acetate) |
| Starch Derivatives | Acrylics |
| Cellulose Derivatives | Sulfonated Polyesters |
| | Polyurethanes |
| | Styrene Copolymers |

Requirements for polymers used for sizing may vary from one type of yarn to another, depending on such things as fiber content, manufacturing processes to be used, anticipated downstream process operations, yarn type, etc. However, useful polymers must generally be a good film-former with abrasion resistance and flexibility. Useful polymers will also typically have one or more of the following properties: compatibility with other ingredients in the formulation; non-corrosive to mill equipment; low foaming; easy removability from the yarns; and relatively low viscosity to allow uniform application to the yarns.

Typical sizing formulations may also have to maintain their stability for many hours at elevated temperatures and contain % solids from as little as 3% to over 20% to achieve equal add-on to sized yarns after drying. A variety of additives, such as antifoam agents, waxes, lubricants are present in representative formulations.

In addition to the film-forming polymer, size mixes generally include lubricant and various other additives. Lubricant wax is added to increase abrasion resistance of the yarn which is especially useful for rapiers and projectile machines. Lubricants with anti-sticking agents, e.g., lecithin, also prevent sticking of the film-forming size polymer, e.g., polyvinyl alcohol (PVA), to dry cans. Emulsifiers are often added to improve solubility. In the case where wax is the lubricant used, paraffin or marine glycerides may be added to harden the wax and better lubricate the yarns. A problem with addition of wax or oil lubricants to size mixes is that not all of the wax or oil may be removed properly during scouring, even when caustic is used for the scour; any remaining wax or oil lubricant may interfere with subsequent operations, including, for example, heat setting (smoke or fumes) and dye stains in dyeing. Nevertheless, the use of lubricant, primarily waxes, in textile sizes has been essentially universally adopted. A variety of additives, such as antifoam agents, waxes, lubricants may also be present in representative formulations.

Conventional processes for sizing warp yarns, are conducted in machines called "slashers". In a slasher, sheets of warp yarns move from a battery of beam creels through a container that contains the sizing formulation. The wetted yarns are subsequently squeezed of excess liquid polymer (wet split), then passed through a series of heated cylinders to dry the warp sheets that are then wound up on a beam for subsequent use in weaving or knitting or other fabric formation process. In some cases, yarns may be sized individually (single end sizing) and are then usually subsequently recombined during, for example, winding.

SUMMARY OF INVENTION

It has now been found that certain non-ionic hydrophilic macromolecular compounds are able to totally replace natural or synthetic waxy lubricants and offer many advantages. For example, in addition to generally superior lubricating properties when used in combination with a sizing agent, the use of the macromolecular compounds tends to soften or plasticize the film-forming sizing agent, such as PVA, thereby resulting in a softer textile fabric. During fabric formation, the hydrophilic macromolecule allows for the amount of PVA or other size to be significantly reduced and, in some cases, eliminated, without loss of weaving/knitting efficiency. Since many of the non-ionic hydrophilic macromolecular compounds exhibit antistatic property, it is possible to avoid use of a separate antistatic agent. Another advantage of the hydrophilic macromolecules relative to conventional waxes is that when slashing a sheet of yarns, the wax lubricants tend to prevent penetration of size between adjacent yarns, whereas the hydrophilic macromolecules allow for better penetration.

Accordingly, in one aspect of the invention there is provided an at least substantially wax-free and oil-free sized warp yarn comprising a warp yarn that has not been formed into a fabric. For purposes of this disclosure, the term "sized yarn" means a yarns that has been treated with a chemical formulation that provides abrasion resistance and/or lubrication of the yarn such that the yarn can undergo processing operations (e.g. fabric formation) with minimal damage to the yarn.

In another aspect, the warp yarn comprises an aqueous sizing composition, which may be applied thereto in a slashing operation (e.g. a sheet type or single end slashing operation). The sizing composition is preferably at least substantially wax-free and oil-free, and more preferably substantially entirely wax-free and oil-free, and comprises a lubricating amount of a nonionic macromolecule formed by vinyl polymerization or condensation reaction, having a hydrophilic component comprising a high molecular weight oxyethylene functionality and a lipophilic component. In a related aspect, fabrics produced from the sized yarns are provided.

In another aspect of the invention, there is provided a process for sizing textile yarns before converting the yarns into a fabric. According to this aspect, textile yarns are contacted with an at least substantially wax-free and oil-free aqueous emulsion comprising water and nonionic macromolecule formed by vinyl polymerization or condensation reaction, having a hydrophilic component comprising a high molecular weight oxyethylene functionality, under conditions which coats or impregnates the textile yarns with a lubricating-effective amount of the macromolecule. Thereafter, the macromolecule is dried on the textile yarns. In another and related aspect, textile yarns are contacted with an at least substantially wax-free and oil-free non-aqueous (e.g., solid, or organic solvent solution) form of the nonionic hydrophilic macromolecule lubricant.

In another aspect of the invention, there is provided a method of producing textile yarns suitable for forming textile fabrics therefrom, the yarns being characterized by having a synthetic fiber component and a durable size coating which remains bound to the yarn throughout wet finishing operations and subsequent use and which not only beneficially contributes to the processing of the textile yarns into textile fabrics but it also beneficially contributes to the physical and aesthetic properties of the yarn and fabrics produced therefrom. The method according to this aspect comprises advancing at least one textile yarn along a predetermined path of travel to and through a size formulation application station and applying to the at least one yarn an aqueous sizing composition which is at least substantially free of wax and lubricating oil and comprising an aqueous non-crosslinking, nonionic macromolecule formed by vinyl polymerization or condensation reaction, having a hydrophilic component comprising a high molecular weight oxyethylene functionality and a lipophilic component; directing the thus treated at least one yarn from the coating station to and through a drying zone and heating the at least one yarn to dry the aqueous sizing composition, directing the thus treated at least one yarn from the drying zone to a take-up station and winding the treated at least one yarn on a take-up roll. In another and related aspect, there is provided a supply package containing a continuous textile yarn and the yarn is treated by the aforementioned steps of advancing, directing, and drying and winding.

In still another aspect of the invention, there is provided a process for forming textile yarns into fabric, comprising applying to the textile yarns, from an at least substantially wax-free and oil-free aqueous emulsion, a lubricating-effective amount of a nonionic macromolecule formed by vinyl polymerization or condensation reaction, having a hydrophilic component comprising a high molecular weight oxyethylene functionality and a lipophilic component, to form sized textile yarns, removing the water from the sized textile yarns, and forming the textile yarns into a fabric.

Still yet another aspect of the invention provides a method of producing a textile fabric formed of at least partially hydrophobic textile yarns having a size coating which is durably bound to the yarns. The method according to this aspect comprises applying to the yarns a coating of an aqueous sizing composition, at least substantially free from wax and oil, and comprising a non-crosslinking, nonionic macromolecule formed by vinyl polymerization or condensation reaction, having a hydrophilic component comprising a high molecular weight oxyethylene functionality and a lipophilic component, drying the sizing composition on the yarn, such that the resulting coating during subsequent use beneficially contributes to the formation of the fabric and also beneficially contributes to the physical and aesthetic properties of the yarns, forming the yarns into fabric, and thereafter subjecting the fabric to at least one wet finishing operation without prior removal of the nonionic macromolecule from the yarns.

In still yet another aspect of the invention, there is provided a textile process which comprises passing an at least partially synthetic spun staple yarn through an aqueous polyvinyl alcohol size composition which is at least substantially free from wax and free from oily lubricant and which contains therein a nonionic hydrophilic macromolecule formed by vinyl polymerization or condensation reaction, having a hydrophilic component comprising a high molecular weight oxyethylene functionality and removing the polyvinyl alcohol size without removing the nonionic hydrophilic macromolecule, such that the yarn comprises adhered thereto, a lubricating effective amount of the nonionic hydrophilic macromolecule.

In any of the above aspects and embodiments of the invention, the aqueous filamentary textile treating composition, may and usually does include a conventional sizing agent, such as starch, starch derivatives, polyvinyl alcohol and polyvinyl acetate (partially hydrolyzed). Other sizes, such as those mentioned in Table 1, above, especially the non-ionic polymer sizes, may also be used. However, the invention also contemplates yarn treatments with the nonionic hydrophilic macromolecule in the absence of added size.

DETAILED DESCRIPTION OF INVENTION AND PREFERRED EMBODIMENTS

Without limiting the scope of the invention, representative disclosed embodiments and features are hereinafter set forth. Unless otherwise indicated, all parts and percentages are by weight of bath where referring to a chemical mixture, and on weight of yarn where referring to a concentration on a yarn, and conditions are ambient, e.g., one atmosphere of pressure and 25° C. The terms "aryl," "aromatic," and "arylene" are intended to be limited to single and fused double ring aromatic hydrocarbons. Unless otherwise specified, aliphatic hydrocarbons are from 1 to 12 carbon atoms in length, and cycloaliphatic hydrocarbons comprise from 3 to 8 carbon atoms.

In the disclosed embodiment, the nonionic hydrophilic macromolecular lubricant compound is usually an antistatic agent. The macromolecular compound is applied to a yarn, prior to fabric formation, along with optional functional additives. The yarn may be a continuous filament or multifilament yarn or spun yarn or combination thereof. The yarn will typically have a denier ranging from 30–500 and have a filament count ranging from 10–200, such as 15–100, or 6s–40s cotton count. The yarn size and the filament count are not deemed to be critical to the practice of the invention, and yarns outside the stated ranges may be used. The macromolecular compound may be applied to individual yarns (single end) or to a plurality of yarns, as in a yarn sheet.

A wide variety of natural and synthetic fibers may be employed. By way of example, the yarns may be made from natural or synthetic fibers, including, for example, polyamide, including nylon, such as nylon 6 and nylon 6,6, and polyaramid, such as sold under the tradename Nomex® (a product of E. I. duPont de Nemours of Wilmington, Del.); polyester, such as polyethylene terephthalate (PET); polyolefin, such as polypropylene; polyurethane acrylic, PTT, carbon, melamine, PLA (polylactic acid); blends of the aforementioned synthetic fibers; and blends of such synthetic fibers with cellulosic fibers, such as cotton, rayon and acetate. In various embodiments, the fiber has a hydrophobic component such as from polyamide fibers, polyester fibers or polyaramide fibers, or blends of such hydrophobic fibers with, e.g. cotton fibers, rayon fibers, or acetate fibers, at blending ratios of hydrophobic fibers to cellulosic fibers of from e.g., 40/60 to 90/10. However, all synthetic or natural, or other blend levels, are contemplated within the scope of the invention.

The sizing formulation may be selected from any of those known in the art and will typically depend on the nature of the yarn (e.g., yarn hairiness), fiber content, yarn structure (e.g., spun, filament, or combination thereof, twisted or untwisted, ring-spun, open-end, jet spun, vortex spun); the type of water to be used for dissolving the PVA (cooking e.g., recycled or fresh); the type and speed of fabric formation to be used (e.g., projectile, rapier, air-jet, or water-jet weaving machine, knitting machine, etc.); the % add-on (and % solids) required; the yarn occupation in the size box and on the dry cans; the desizing procedures; slasher design and number of size boxes; environmental restrictions and such other factors well known to those skilled in the art. Also of consideration is the viscosity of the size solutions since the penetration of size into the yarn depends on, for example, the amount of twist (twist per inch), particularly for ring spun yarns. Generally, however, sizes based on polyvinyl alcohol (PVA) (including partially hydrolyzed polyvinyl acetates, and copolymers thereof) or starch (including starch derivatives), or combinations of starch/PVA, are used in embodiments of the invention.

Since sizing is not a "value-added" process for textile manufacture, minimizing the cost associated with sizing, while optimizing weaving performance, is of practical significance. It has been found in accordance with embodiments of the invention that the nonionic hydrophilic lubricant macromolecules used herein are able to reduce the amount of sizing agent required (e.g., PVA) by as much as 50% without sacrificing weaving performance and, at the same time, enhancing the properties of the resulting yarns and fabrics produced therefrom. In some cases, no sizing agent is used. For example, 100% synthetic filament yarns may in some cases be woven without including a conventional size agent in the size formulation.

The non-ionic hydrophilic macromolecule lubricant which is used in embodiments of the present invention is also a soil release agent to thereby enhance the performance of the textile article made from the yarn as well as to facilitate the yarn handling and finishing processes. The size composition may be applied to achieve a lubricant add on (lubricating effective amount) of the nonionic hydrophilic macromolecule. In one embodiment, this amount may be from 0.15 to 6 wt % based on the weight of the yarn (owy) such as, for example, from 0.375 to 2% owy, e.g., 0.4 owy, 0.5 owy, 0.75 owy, 1.0 owy, 1.25 owy, 1.4 owy., 1.5 owy.

The lubricants that are used in embodiments of the invention are macromolecules having a nonionic hydrophilic component, such as an oxyethylene group, and a lipophilic component. The backbone of the macromolecule is generally formed by either vinyl polymerization or condensation reaction. The macromolecules according to an embodiment of the invention have molecular weights (weight average) which may range from 500 to 100,000, such as from 1,000 to 50,000, or from 5,000 to 50,000. The molecular weight of the macromolecule is such that the nonionic lubricant is normally solid. The molecular weight of the hydrophilic oxyethylene group is such that the macromolecule will readily dissolve or emulsify at ambient temperature when contacted with water and provide a lubricating/antistatic property to hydrophobic (e.g., polyester) fibers when applied thereto within the amounts indicated previously. For example, the molecular weight of the hydrophilic portion of the macromolecule may range from about 300 to about 5,000, such as from about 400 to about 3,000, for example, a molecular weight of 300, 400, 500, 750, 1,000, 1,200, 1,500, 1,750, 1,800, 2,000, 2,500, 3,000, or 4,000. The molecular weight of the polyester (hydrophobic or lipophilic) component is generally sufficiently high so as to render the macromolecule a good film-former and able to withstand the forces and treatments to which treated yarn is likely to be exposed during further processing and during textile fabric formation. By way of example, molecular weights of the lipophilic component may be as high as about 100,000, such as 10,000, 20,000, 30,000, 40,000, 50,000, 60,000, 75,000 or 80,000.

Suitable lubricants include, for example, non-ionic macromolecules having oxyethylene hydrophiles, such as the condensation polymers of polyethylene glycol and/or ethylene oxide addition products of acids, amines, phenols and alcohols which may be monofunctional or polyfunctional, together with binder molecules capable of reacting with the hydroxyl groups of compounds with a poly(oxyalkylene) chain, such as organic acids and esters, isocyanates, compounds with N-methyl and N-methoxy groups, bisepoxides etc.

In one embodiment, the hydrophilic lubricant macromolecule is a condensation product of aromatic ester groups, such as, dimethyl terephthalate, or other ester-forming derivative of terephthalic acid, ethylene glycol and polyethylene glycol (ethoxylated polyester) and/or ethoxylated polyamide, especially ethoxylated polyesters and polyamides having a molecular weight of at least 500. Other suitable lubricants are described in the following patents, U.S. Pat. Nos. 3,416,952; 3,660,010; 3,676,052, 3,981,807; 3,625,754; 4,014,857; 4,207,071; 4,290,765; 4,068,035 and 4,937,277.

In one embodiment, the hydrophilic macromolecule lubricant contains from about 10 to 50% by weight of ethylene terephthalate repeat units together with from about 90 to 50% by weight of oxyethylene repeat units, which are usually derived from a polyoxyethylene glycol, and having an average molecular weight from about 1,000 to about 4,000, and wherein the molar ratio of ethylene terephthalate repeat units to oxyethylene repeat units is from about 1:20 to about 1:2, such as, for example, 1:10, 1:9, 1:8, 1:7, 1:6, 1:5, 1:4, 1:3. One example of a hydrophobic lubricant macromolecule for use in the present invention comprises the reaction product of ethylene glycol, dimethyl terephthalate and a polyoxyethylene glycol containing from 1 to about 50 ethylene oxide repeat units which may be prepared as described, e.g., in Example 11 of U.S. Pat. No. 3,416,952. Another example of a hydrophilic lubricant macromolecule is commercially available from PPG Industries, Inc. under the trademark, "Larosol®214A". This material is available as an aqueous dispersion of the reaction product of ethylene glycol, dimethyl terephthalate and polyoxyethylene glycol, the latter having an average molecular weight of about 1450. Another commercially available hydrophilic lubricant macromolecule suitable for use in the invention is a product sold by ICI America under the trademark, "Milease®T". The Milease®T material is believed to be that prepared according to Example 19 of U.S. Pat. No. 3,416,952. Still another example of a commercially available soil release material which may be used as the hydrophilic lubricant according to the invention are the family of ethoxylated polyesters available from Eastman Chemical under the trademark, Lubril®, such as grade QCX, which is believed to be the reaction product of polyethylene glycol (MW about 3,000 to 4,000) and a high molecular weight (about 50,000) polyethylene terephthalate, and containing about 80–90% by weight of PEG and about 10–20% by weight of polyester. A small amount of emulsifier or surfactant may be present to facilitate stability of the emulsion.

The sizing formulation may be in the form of an emulsion, dispersion or solution. In one embodiment, the lubricant is used in the form of an emulsion, with a small but effective amount of an emulsifying agent. Generally, however, addition of emulsifying agent beyond the amounts added by the manufacturer, is not required and in embodiments of the invention, emulsifying agents or surfactants are not added to the finishing size composition. The nonionic hydrophilic lubricant may, however, also be used as a solid. Such solid will normally be sufficiently soft and/or flexible so that an effective amount of lubricant may be transferred from the solid mass directly to the yarn by movingly contacting, e.g., rubbing, the yarn (either single strands or as a yarn package or yarn sheet) and the solid lubricant. In addition, in some embodiments of the invention the nonionic hydrophilic macromolecule may be applied to the yarn from a solvent solution thereof. In such case, the solvent would be removed in a conventional manner for solvent removal, as will be appreciated by those of ordinary skill in the art.

The size compositions according to embodiments of the invention, when dried, provide homogeneous, flexible films in which, it is believed, the nonionic hydrophilic lubricant macromolecule is evenly distributed throughout the size, e.g., polyvinyl alcohol (including partially hydrolyzed polyvinyl acetate and copolymers thereof). In contrast, the films formed upon drying conventional PVA/wax size compositions tend to be very stiff and with the wax non-uniformly distributed in the PVA. Accordingly, in embodiments of the invention wherein the size is not removed from the textile fabric, such as in the production of upholstery fabrics, the sized fabrics of the invention have more flexibility, softer feel and better dyeability and printability.

Satisfactory results have been achieved with sizing compositions containing 45 wt % or greater, such as, 50 wt % or greater, for example, 70 wt % or greater, water, e.g., 99% water; 98% water; 96% water; 94% water; 90% water; 87% water; 86% water; 80% water.

Compositions having the following ranges, for example, may be employed:

0.5 to 25 wt. % of sizing agent (as solids);
0.1 to 15 wt. % of a lubricant (as solids);
60 to 99.4 wt. % water; and
up to 5 wt. % auxiliaries.

In a particular embodiment, the composition is an emulsion having from:

1 to 15 wt. % sizing agent (as solids);
0.25 to 5 wt. % of a lubricant (as solids);
80 to 98.75 wt. % water; and
up to 3 wt. % auxiliaries.

The concentration of lubricant is intended to include optional emulsifiers if necessary to form a more stable emulsion, however, emulsifiers may not be required.

Suitable representative auxiliaries include, for example, biocides, antistatic agents (usually not necessary since the lubricant in embodiments of the invention also functions as an antistatic agent), anti-sling agents, and wetting agents, emulsifiers, surfactants, and their use in fiber treatments is well known to those skilled in the art.

The invention is highly advantageous in that conventional lubricating oils, such as the mineral oil derivatives (e.g., paraffinic, alicyclic and aromatic hydrocarbons and combinations thereof); and synthetic oils (e.g., organic esters such as $C_{6-C18}$ esters of fatty acids with $C_{6-C10}$ alcohols; esters of higher polyols such as triglycerides; esters of pentaerythritol; alkoxylated fatty acids and alcohols; propylene oxide and ethylene oxide adducts of $C_{10-C18}$ organic acids and alcohols; low molecular weight polyolefins, which are liquid at ambient conditions, such as polyisobutylene and polyalphaolefins; and silihydrocarbon oils) are not required or used in the sizing compositions. Accordingly, there is no need to subject the yarns or textile fabrics therefrom to scouring nor is there a need to recover these oily substances for recycling or disposal. It is understood, however, that scouring or desizing may still be required to remove size as will be appreciated by those skilled in the art.

It is also understood that wax and/or oil (e.g., coning oil) may be used during the manufacture of fibers or filaments or yarns to be treated herein and small amounts of such wax and/or oil may remain on the yarns to which the nonionic hydrophilic lubricant macromolecule lubricant according to the invention is applied. To account for such residual amounts of wax and/or oil from the upstream fiber/yarn manufacturing process, the term "substantially free from" or "substantially wax-free and oil-free" or equivalent language is used in connection with the lubricated and sized yarns according to the invention and the sizing or lubricating compositions used herein. Such residual amounts comprehended by "substantially" are less than the amounts which are considered to be effective to provide lubricant effect for the subsequent processing of the sized or lubricated yarns in the production of fabric. Therefore, by the expression, "at least substantially" is intended to include from none to such small amounts of oil and/or wax which do not function as lubricant in subsequent yarn processing, including during weaving or knitting of yarn into fabric.

All of the United States patents heretofore listed are incorporated by reference herein.

The sizing agent and macromolecular lubricant may be combined, along with the desired ancillary additives, to form an aqueous emulsion using conventional techniques.

As noted above, lubricant which may be used in embodiments of the invention are commercially available, in the form of an aqueous dispersion, solution or emulsion. However, where the nonionic hydrophilic lubricant is available in solid form, the lubricant may be applied as such, by, for example, rubbing. The aqueous dispersion, solution or emulsion may also be dried to obtain the solid lubricant and, after drying, may be applied by, for example, rubbing. The nonionic hydrophilic macromolecular lubricant may also be applied from an organic solvent solution.

The lubricant composition may be applied at any stage of yarn processing that a sizing or finishing composition may be applied. In particular embodiments of the invention the size composition is applied by slashing, as is well known to those skilled in the art of textile manufacture.

The lubricant, with or without size, may be applied by conventional techniques used to apply a continuous or discontinuous coating to yarn during the slashing operation, such as described, for example, in U.S. Pat. No. 4,756,714. Typically, a large number of textile yarns arranged in parallel side-by-side relation is supplied from section beams and directed through a suitable applicator, such as padding, spraying, rubbing, flicking, foaming, and the like, for applying the sizing composition to the yarns. After leaving the applicator, e.g., pad, the yarns pass across a series of heated metal drying cans which serve to dry the sizing composition. The add-on of size composition (as is) ranges from 1 to 30 wt. % owy (on weight of yarn), such as, from 3 to 15 wt. % owy, for example, from 3 to 8 wt % owy.

Following application of the present size to the yarn, the yarn may be handled and processed as are yarns treated with conventional finishing or sizing compositions. For example, the yarn may be wound into a package and then formed into a fabric, preferably a woven or knitted fabric, as is well known in the art. The yarn or fabric, because no wax component is present in the size, does not requiring caustic or other specific treatment to remove the wax/oil component. However, other treatments, such as, for example, desizing to remove the size (e.g., polyvinyl alcohol, starch) heat setting, dyeing, or the like may be carried out. Since PVA size forms true solutions in water, it is only required, during desizing, to contact the fabric with hot water.

It is not always necessary to desize the fabric, and in some cases, such as for some industrial fabrics, the size, e.g., PVA, is intentionally allowed to remain on the fabric to function as a primer coating for adhesion to the coatings used on industrial fabrics.

It is likewise, not always necessary to add size to filaments or yarn as such embodiments are also within the scope of the invention.

EXAMPLES

The following examples show the relative softness of fabrics obtained using a slashing composition with nonionic hydrophilic lubricant in place of wax lubricant.

In these examples, softness is measured by the Handle-O-Meter standard test, INDA Standard Test: 1ST 90.3 (95) for measuring stiffness of nonwoven or woven fabrics. Basically, according to this test method, the fabric is deformed through a restricted opening by a plunger and the required force is measured. This force is a measure of both flexibility and surface friction of the fabric. The quality of "hand" is considered to be the combination of resistance due to the surface friction and the flexural rigidity of a sheet material. The determination of the combined effects of stiffness and thickness have been shown to correlate excellently with finished product performance. A lower result indicates a softer fabric.

The test specimens are 200 mm×200 mm (8.0×8.0 inches) cut from each material. Each test specimen is placed under the blade on a specimen platform with side one facing up and machine direction perpendicular to the slot. The specimen is arranged so that ⅓ of the specimen is to the right of the slot and ⅔ to the left.

The tester is activated and the maximum reading is recorded.

The specimen is removed from the slot, keeping side one up. The specimen is rotated counter clockwise so that the cross section is perpendicular to the slot. Again, the specimen is arranged so that about ⅓ of the specimen is to the right of the slot and ⅔ to the left.

The tester is again activated and the maximum reading is recorded. The readings are recorded in milli-newtons.

Example 1

A size formula was prepared by heating a solution of 10% corn starch to 185° F. and adding 0.5% Abco 515 wax (Abco Chemicals) and 89.5% water. The resulting sizing composition was slashed onto 65/35 polyester/cotton yarns for weaving into a light weight fabric (32 ends per inch×32 picks per inch osnaburg weave fabric, containing 15 single open-end polyester/cotton yarns) in a conventional manner (dried, woven and taken up.)

Example 2

The same fabric from Example 1 was instead slashed with 5% PVA size (Elvanol T-99 available from DuPont) and 2% Lubril QCX and 93% water.

The results are shown in the following Table 1.

TABLE 1

| | Example 1 Cornstarch/Wax (10%/0.5%) | Example 2 PVA (T-99)/Hydrophilic Lubricant (5%/2%) |
|---|---|---|
| Warp | 79.0 | 30.7 |
| Fill | 17.7 | 16.0 |
| Average | 48.4 | 23.4 |

Softness of the fabrics obtained in Examples 1–2 are separately measured by the Ring Tensile Test. In this test, all of the instruments operate on the principle of deforming the fabric through a restricted opening. More particularly, the fabric sample (10-inch diameter circle) is pulled through a ring (38 mm diameter with a radius of 24 mm) at a set rate to determine the forces associated with friction and bending.

The following procedure is used: The center of each 10-inch circular sample is marked. A small fishhook on the end of string, with back removed, is attached to the center of the fabric sample. The other end of the string is attached to the crosshead of the tensile tester. The test is begun and run until the fabric is pulled completely through the ring. The force required to pull the fabric sample as it approaches the ring are recorded.

The results are shown in the following Table 2.

TABLE 2

| Example 1 Cornstarch/Wax (10%/0.5%) | Example 2 PVA (T-99)/Hydrophilic Lubricant (5%/2%) |
|---|---|
| 384 | 240.7 |

What is claimed is:

1. A process for forming textile yarns into fabric, the process comprising the steps of applying to said textile yarns a wax-free and oil-free aqueous emulsion size mixture comprising a polyvinyl alcohol and a hydrophilic lubricant macromolecule to deposit a lubricating-effective amount of the hydrophilic lubricant macromolecule and the polyvinyl alcohol onto said textile yarns and form sized textile yarns, wherein the textile yarns are a blend of cotton and synthetic fiber, and wherein the hydrophilic lubricant macromolecule is a condensation product of aromatic ester groups which contains from about 10 to 50% by weight of ethylene terephthalate repeat units together with from about 50 to 90% by weight of oxyethylene repeat units, removing the water from the sized textile yarns, and forming fabric from said sized textile yarns, wherein the molar ratio of ethylene terephthalate repeat units to oxyethylene repeat units is from about 1:20 to about 1:2.

2. Process according to claim 1, further comprising desizing the fabric.

3. Process according to claim 1, wherein the step of forming fabric from said sized textile yarns comprises weaving the sized textile yarns into a woven fabric.

4. Process according to claim 1, wherein the step of forming fabric from said sized textile yarns comprises knitting the sized textile yarns into a knitted fabric.

5. Process according to claim 1, wherein the synthetic fiber is polyester.

6. A process for producing a textile fabric formed of textile yarns containing a synthetic fiber component and having a size coating bound to the yarns, the process comprising the steps of:

applying to the yarns a coating of an aqueous sizing composition comprising a polyvinyl alcohol and a non-crosslinking, nonionic macromolecule, wherein the textile yarns are a blend of cotton and a synthetic fiber, and wherein the aqueous sizing composition is free from wax and oil, and wherein the nonionic macromolecule is a condensation product of aromatic ester groups which contains from about 10to 50% by weight of ethylene terephthalate repeat units together with from about 90 to 50% by weight of oxyethylene repeat units and wherein the molar ratio of ethylene terephthalate repeat units to oxyethylene repeat units is from about 1:20 to about 1:2;

drying the sizing composition on the yarn to adhere the nonionic macromolecule to the yarns and bind the size coating and, forming the yarns into fabric.

7. Process according to claim 6, wherein the step of forming the yarns into fabric comprises weaving the yarns.

8. Process according to claim 6, wherein the synthetic fiber is selected from the group consisting of polyester, polyamide, polyarylamide, and blends thereof.

9. Process according to claim 6, wherein the synthetic fiber is polyester.

* * * * *